US007237543B2

(12) United States Patent
Su

(10) Patent No.: US 7,237,543 B2
(45) Date of Patent: Jul. 3, 2007

(54) GAS MAGAZINE OF A TOY GUN

(75) Inventor: Min-Hui Su, Taipei Hsien (TW)

(73) Assignee: Yueh-Mei Chen, Luzhou, Taipei County (TW)

( * ) Notice: Subject to any disclaimer, the term of this patent is extended or adjusted under 35 U.S.C. 154(b) by 394 days.

(21) Appl. No.: 11/000,195

(22) Filed: Dec. 1, 2004

(65) Prior Publication Data

US 2006/0112944 A1 Jun. 1, 2006

(51) Int. Cl.
*F41B 11/00* (2006.01)

(52) U.S. Cl. ..... 124/71; 124/73; 124/74

(58) Field of Classification Search ..... 124/73–77
See application file for complete search history.

(56) References Cited

U.S. PATENT DOCUMENTS 5,711,286 A * 1/1998 Petrosyan et al. ..... 124/73
6,026,797 A * 2/2000 Maeda et al. ..... 124/74
6,112,734 A * 9/2000 Kunimoto ..... 124/73
6,892,718 B2 * 5/2005 Tiberius et al. ..... 124/74

* cited by examiner

*Primary Examiner*—Stephen M. Johnson
*Assistant Examiner*—Gabriel J. Klein
(74) *Attorney, Agent, or Firm*—Birch, Stewart, Kolasch & Birch, LLP

(57) ABSTRACT

A toy gun comprising a bullet chamber, a gas bottle container, a regulation valve, a regulation chamber and a control valve in a magazine shell, at least one partitioner is installed inside the regulation chamber, the partitioner subdivides the regulation chamber into several small chambers in series, several small holes are on the partitioner to interlink these small chambers, the small holes are made in conical shape with smaller diameter toward first chamber side. In real application, the gas flows from the gas bottle to the first chamber then to next chambers through those small holes, the gas entering the first chamber cannot flow into the next chamber completely as the gas flow reservation and buffering effect, the gas pressure variation is minimized at the regulation valve close moment and offer a stable, safe shooting power source.

2 Claims, 5 Drawing Sheets

GAS MAGAZINE OF A TOY GUN

BACKGROUND OF THE INVENTION

I. Field of the Invention

This invention relates generally to a gas magazine and, more specifically, to a gas magazine of a toy gun that applies high pressure $CO_2$ or other gas as power source, the high pressure gas enters regulation chamber after the regulation valve, with the regulation chamber portioning into two or more storage spaces in series and interlinking with small holes, the high pressure gas is buffered by these small holes to have the gas pressure into next chamber be lower, more stable to assure the shooting power is within safety range.

II. Description of the Prior Art

Heretofore, it is known that the structure of the gas bottle magazines of toy guns, as shown in FIG. 4 and FIG. 5, mainly consist of a bullet chamber a, a gas bottle container b, a regulation valve c, a regulation chamber d and a control valve e in a magazine shell; a high pressure gas bottle f filled with high pressure gas ($CO_2$ or other gas) is installed inside the gas bottle container b connecting to the regulation valve c, gas inside the gas bottle f flows into the regulation chamber d; until the pressure of the second side of the regulation valve c is larger than the first side, the regulation valve closes; when users press the trigger and shoot, the control valve e releases gas immediately, pushes the bullet out and finishes the shooting.

Based on the known structure described above, at the moment when the regulation valve c opens and lets the high pressure gas of the gas bottle f flow into the regulation chamber d and before the regulation valve c closes, the gas bottle f interlinks to regulation chamber d, the high pressure gas inside the gas bottle flows rapidly into the regulation chamber d, since the gas flow is too fast, when the pressure reaches the preset value, the mechanical operation of the shutoff switch c1 of the regulation valve c delays a little bit, the more precision of the mechanical structure, the longer the delay, the delay time might be only in hundredth or tenth of second, such delay to gas flow with fast speed might generate extra gas inside the regulation chamber e, this might further cause damage to the composed parts, or shooting strength unstable situation or extra antipersonnel force; if above condition happens, especially in fast continuous shooting, the control valve e might open, release gas and shoot before the regulation valve c complete closes, the released gas pressure offers by the high pressure gas bottle f, the released gas pressure equals to the pressure of the gas bottle f, such might cause accident antipersonnel force and damage to composed parts.

SUMMARY OF THE INVENTION

It is therefore a primary object of the invention to provide a gas magazine of a toy gun that subdivides the regulation chamber into two or more chambers in series, and applies small holes between two chambers as gas reservation and buffering effect to assure the shooting gas pressure maintain at a stable condition for better safety effect.

In order to achieve the objective set forth, a gas magazine of a toy gun in accordance with the present invention comprises a bullet chamber, a gas bottle container, a regulation valve, a regulation chamber and a control valve in a magazine shell, at least one partitioner is installed inside the regulation chamber, the partitioner subdivides the regulation chamber into several small chambers in series, several small holes are on the partitioner to interlink these small chambers, the small holes are made in conical shape with smaller diameter toward first chamber side.

While in real application based on above structure, the gas flows from the gas bottle connecting beneath the regulation valve to the first chamber then to next chamber through those small holes, the gas entering the first chamber cannot flow into the second chamber completely as the gas flow reservation and buffering effect, gas pressure will be decompressed from previous chamber to next chamber as the gas flow is slower; after the second chamber, the gas pressure variation is minimized at the regulation valve close moment and offer a stable, safe shooting power source.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DESCRIPTION OF THE PREFERRED EMBODIMENT

Figure 1:
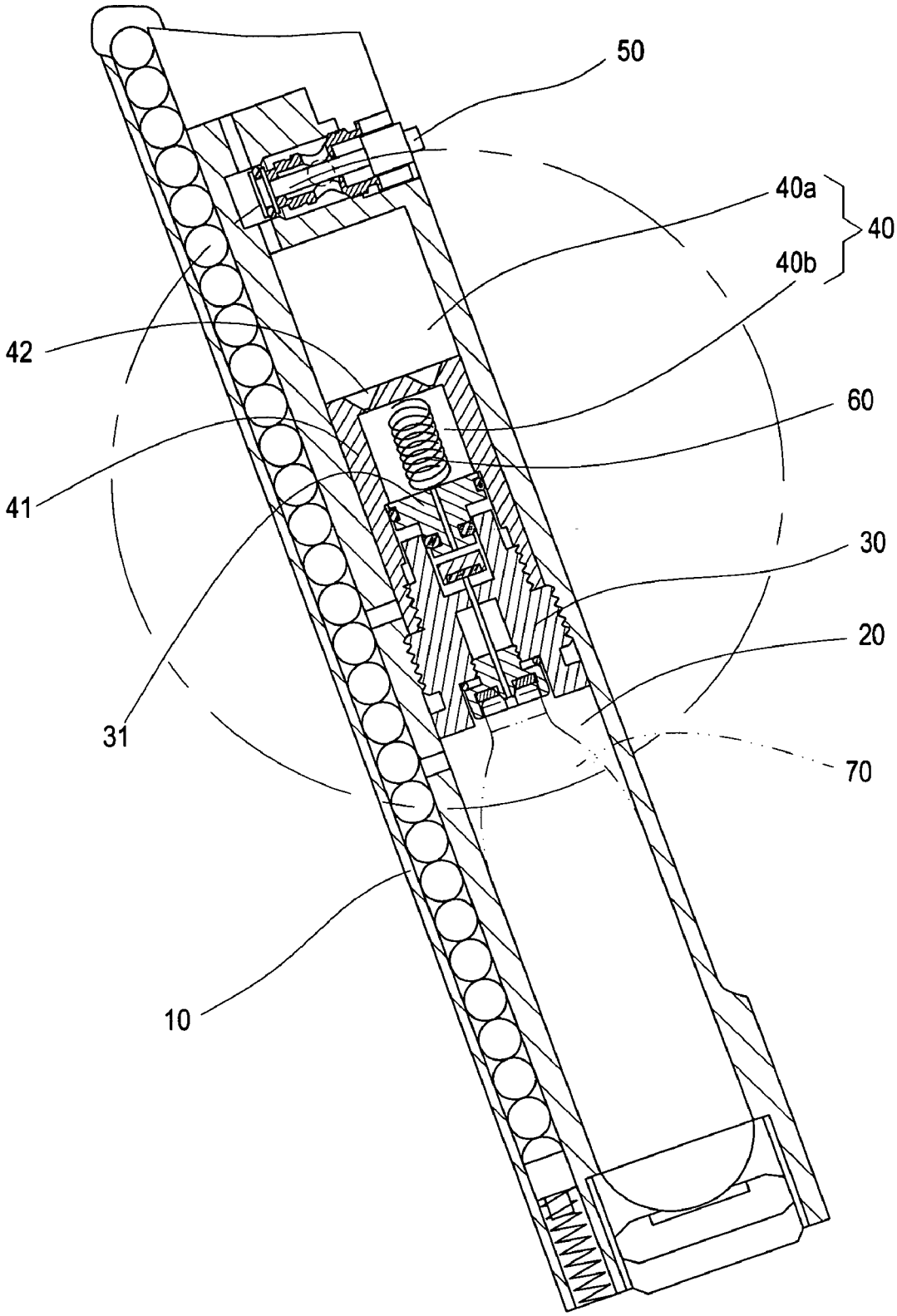
FIG. 1 is a cross-sectional view of the present invention.
Figure 2:
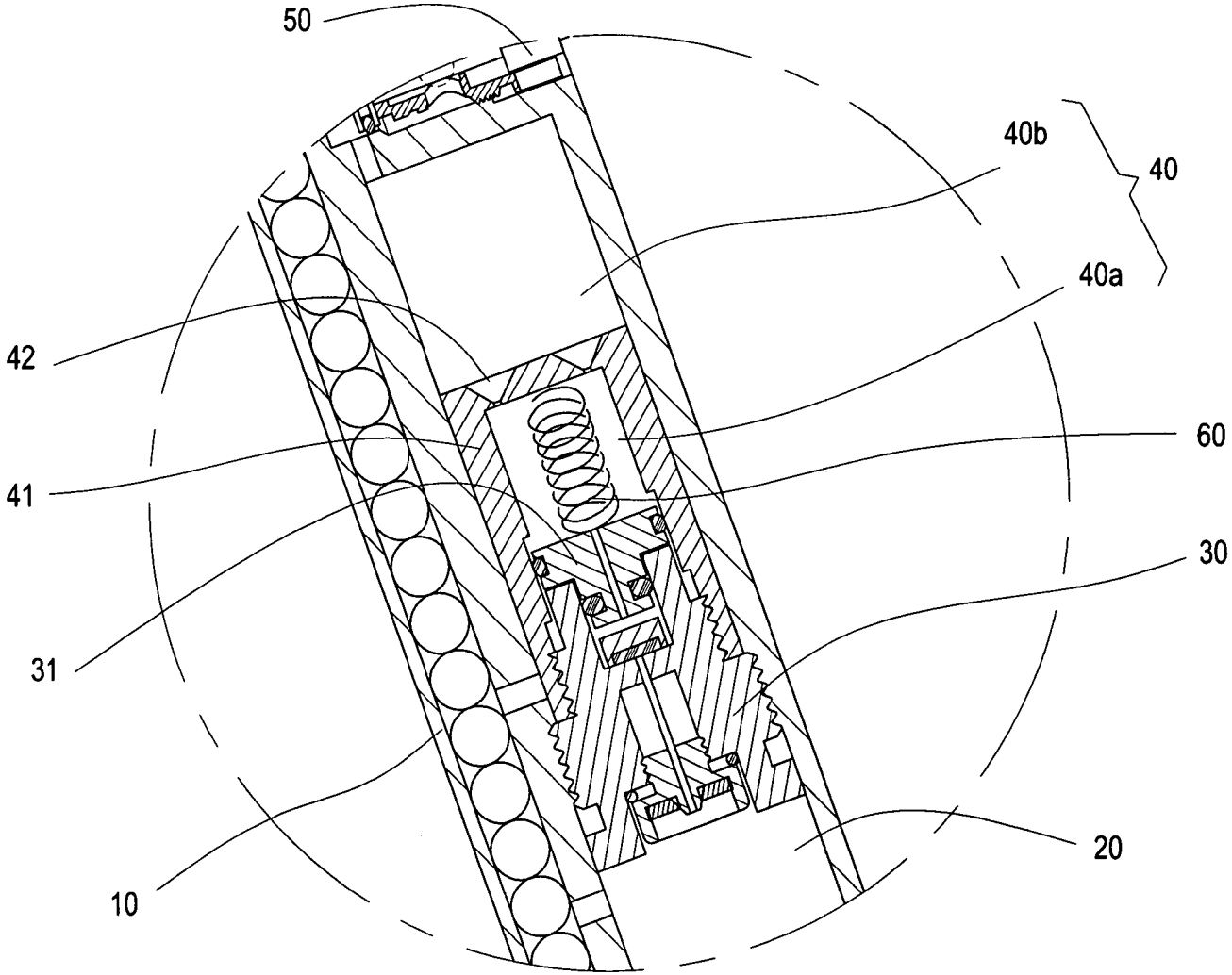
FIG. 2 is an enlarged cross-sectional view of the present invention.

Referring to FIG. 1 and FIG. 2, the present invention comprises a bullet chamber 10, a gas bottle container 20, a regulation valve 30, a regulation chamber 40 and a control valve 50 in a magazine shell. Depend on the pressure value of gas stored inside the regulation chamber 40, a decompression spring 60 can be installed on top or the bottom of the piston 31 of the regulation valve 30, or depend on the physical size on top and bottom of the piston 31 to design and control the triggering pressure power within safety standard range.

Figure 3:
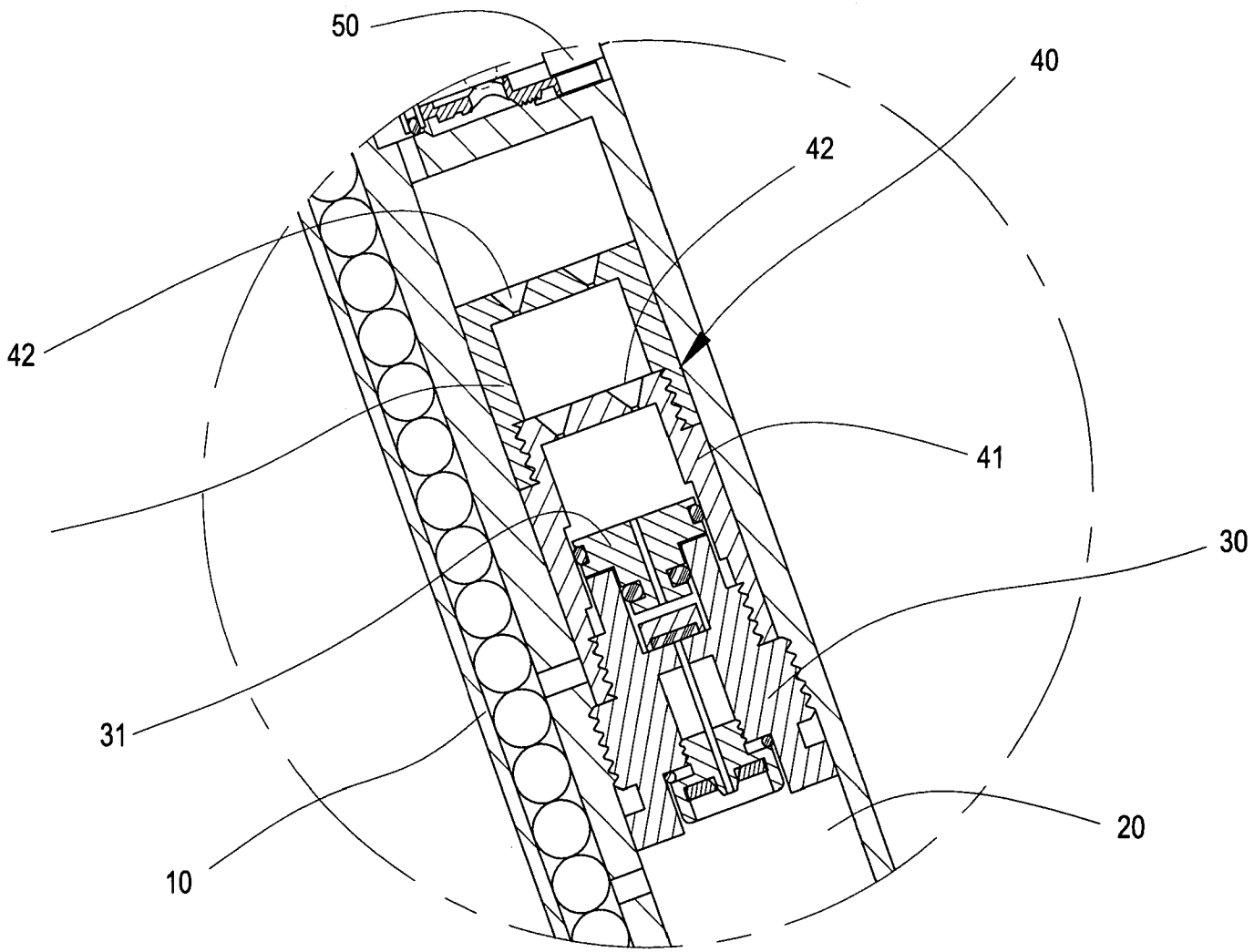
FIG. 3 is a cross-sectional view of another application of the present invention.
Figure 4:
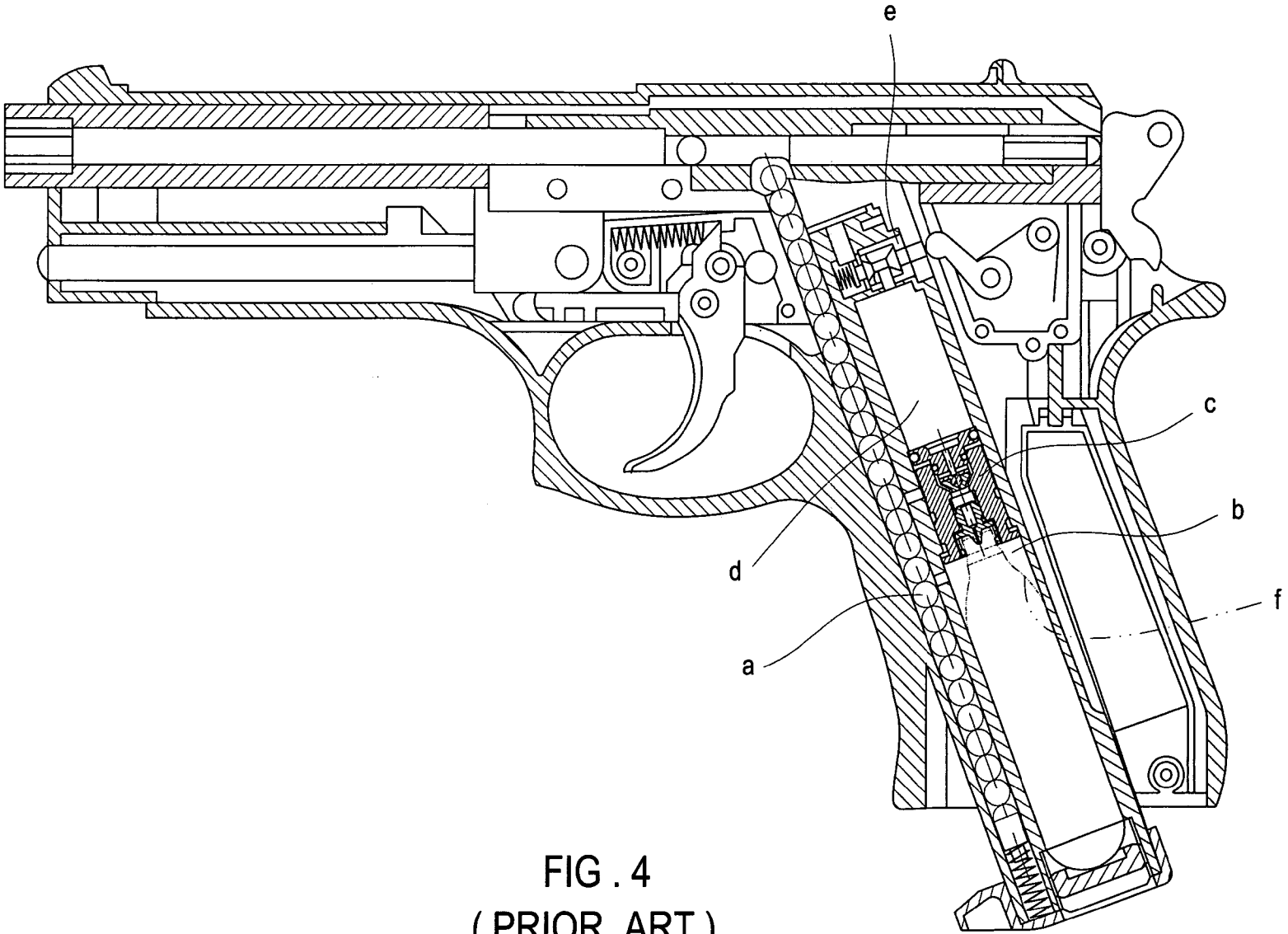
FIG. 4 (PRIOR ART)
FIG. 4 is a cross-sectional view of the prior art.
Figure 5:
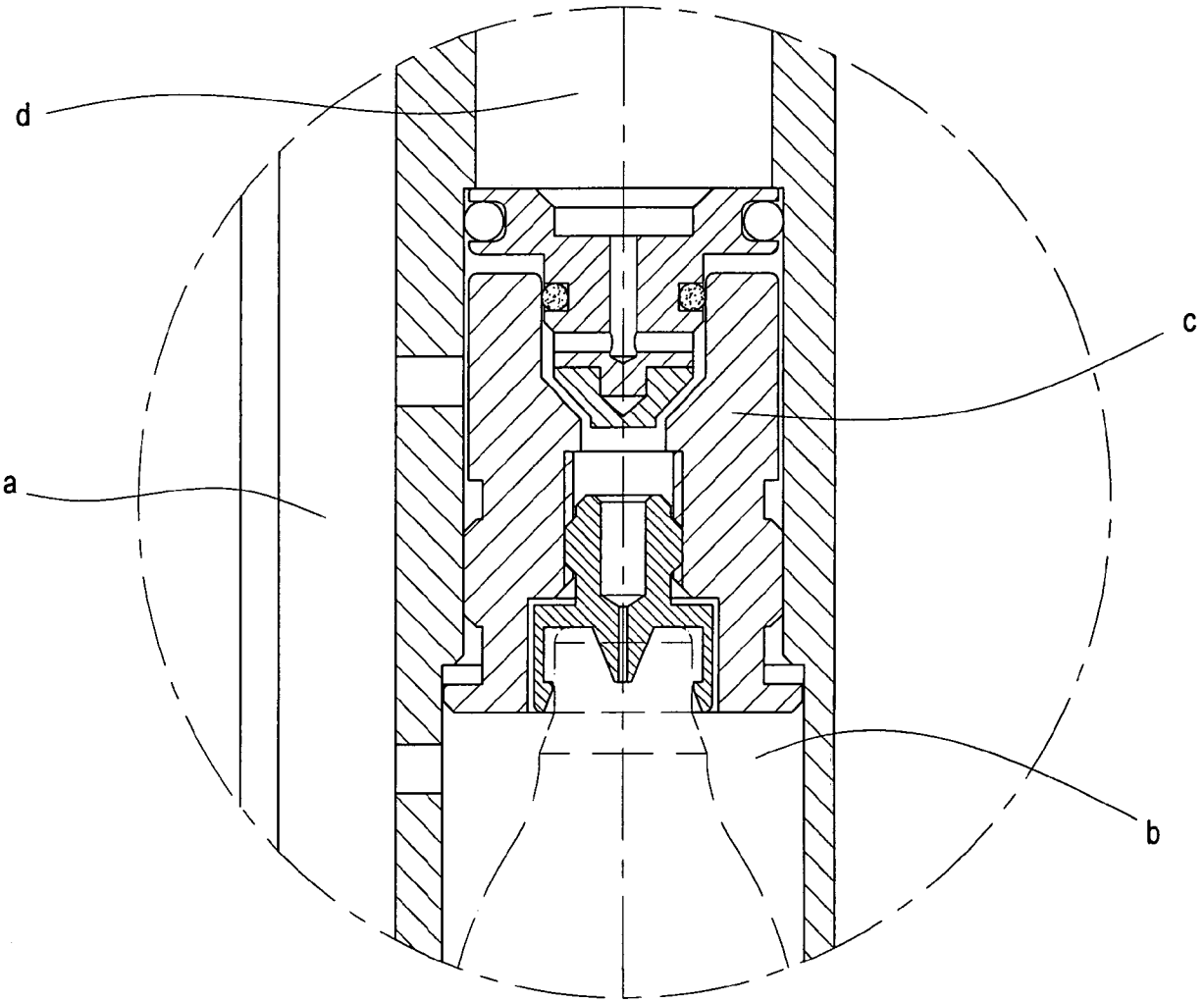
FIG. 5 (PRIOR ART)
FIG. 5 is an enlarged cross-sectional view of the prior art.

The major character is: at least one partitioner 41 is installed inside the regulation chamber 40 that is above the regulation valve 30, the partitioner 41 subdivides the regulation chamber 40 into a first chamber 40*a* and a second chamber 40*b* in series, several small holes 42 are on the partitioner 41 to interlink the first and second chamber 40*a* and 40*b*. In real application, the regulation chamber 40 is subdivided into two or more gas chambers by two or more partitioners 41, as shown in FIG. 3.

While application, the small holes 42 are made in conical shape in the first chamber 40*a* side; when gas flows, the resistance for gas to flow from the first chamber 40*a* into the second chamber 40*b* is larger, the resistance from the second chamber 40*b* into the first chamber 40*a* is smaller, such effect buffers gas flow into second chamber 40*b* to balance the pressure in the first and second chambers 40*a*, 40*b* rapidly.

While in real application based on above structure, the gas flows from the gas bottle 70 connecting beneath the regulation valve 30 to the first chamber 40*a* then to the second chamber 40*b* through those small holes 42, since these small holes 42 have smaller diameter than that of valve open of the regulation valve 30, the gas entering the first chamber 40*a* cannot flow into the second chamber 40*b* completely as the gas flow reservation and buffering effect, the high pressure gas in the gas bottle 70 will not rush into the second chamber

40*b* in a short period of time, after the regulation valve closes completely, the higher gas pressure in the first chamber 40*a* still flows slowly into the second chamber 40*b* to have the gas pressure of the first and the second chamber 40*a* and 40*b* maintain balance; even the gas pressure in the first chamber 40*a* is higher than normal value as the regulation valve 30 closes slower, the second chamber 40*b* can balance out the extra gas pressure with the initial lower gas pressure, the pressure variation can be minimized, the output gas pressure of the second chamber 40*b* is maintained within limited range to assure product safety.

For example, at the regulation valve 30 complete shutoff moment, if the gas pressure of the high pressure gas bottle 70 is 100 kg/cm$^2$, and the gas pressure enters the first chamber 40*a* is 30 kg/cm$^2$ which is higher than the normal safety pressure, if the gas pressure of the second chamber 40*b* is 20 kg/cm$^2$, the deferring effect of the small holes 42 of the partitioner 41 can mix the gas pressure of the first and the second chambers 40*a* and 40*b* for a balance value to control the shooting gas pressure value; the partitioner 41 also acts as a door between the high pressure gas bottle 70 and the second chamber 40*b*; in fast continuous shooting, the high pressure gas from the high pressure gas bottle 70 will not enter directly into the second chamber 40*b* to assure application safety.

While a preferred embodiment of the invention has been shown and described in detail, it will be readily understood and appreciated that numerous omissions, changes and additions may be made without departing from the spirit and scope of the invention.

What is claimed is:

1. A gas magazine of a toy gun comprising:

a bullet chamber (10), a gas bottle container (20), a regulation valve (30), a regulation chamber (40) and a control valve (50) in a magazine shell;

at least one partitioner (41) is installed inside said regulation chamber (40) that is above said regulation valve (30), said partitioner (41) subdivides said regulation chamber (40) into several chambers in series, several small holes (42) are on said partitioner (41) to interlink said chambers (40*a*) and (40*b*).

2. The gas magazine of a toy gun recited in claim 1, wherein said small holes are made in conical shape with smaller diameter toward first said chamber side.

* * * * *